US007661839B2

(12) United States Patent
Tsai

(10) Patent No.: US 7,661,839 B2
(45) Date of Patent: Feb. 16, 2010

(54) LIGHT STRUCTURE

(76) Inventor: Hua-Hsin Tsai, No. 105, Jhongyang Rd., Jioucyong Village, Linnei Township, Yunlin County (TW)

( * ) Notice: Subject to any disclaimer, the term of this patent is extended or adjusted under 35 U.S.C. 154(b) by 200 days.

(21) Appl. No.: 11/797,111

(22) Filed: May 1, 2007

(65) Prior Publication Data

US 2008/0273322 A1 Nov. 6, 2008

(51) Int. Cl.
*F21S 4/00* (2006.01)

(52) U.S. Cl. ..... 362/223; 313/485; 313/493; 382/216; 382/217.01; 382/217.08; 382/260

(58) Field of Classification Search ..... 362/216, 362/217, 260, 223; 313/112, 113, 116, 324, 313/485, 493
See application file for complete search history.

(56) References Cited

U.S. PATENT DOCUMENTS 2,299,720 A * 10/1942 Holman ..... 313/489
4,048,537 A * 9/1977 Blaisdell et al. ..... 313/489
5,053,933 A * 10/1991 Imris ..... 362/221
6,348,763 B1 * 2/2002 Collins ..... 313/634
6,630,780 B1 * 10/2003 Yan ..... 313/493
7,530,715 B2 * 5/2009 Mii ..... 362/293

* cited by examiner

*Primary Examiner*—Stephen F Husar
*Assistant Examiner*—James W Cranson
(74) *Attorney, Agent, or Firm*—Rosenberg, Klein & Lee

(57) ABSTRACT

A light includes a light-producing inner tube, and an outer tube positioned around the light-producing inner tube; the light-producing inner tube has electrical terminals at two ends thereof, which sticks out of the outer tube; the outer tube has a light reflecting film on an outer side of a first portion thereof; an inner side of the first portion of the outer tube is processed so as to have a rough and lumpy surface, which can cause light produce by the light-producing inner tube to travel in all directions; the outer tube has a fluorescent layer on each of inner and outer sides of a second portion thereof, which make the second portion of the outer tube more pervious to light.

7 Claims, 5 Drawing Sheets

LIGHT STRUCTURE

BACKGROUND OF THE INVENTION

1. Field of the Invention

The present invention relates to a light structure, more particularly one, which includes a light-producing inner tube, and an outer tube including a first portion having a relatively good light reflectivity, and a second portion having relatively good perviousness to light.

2. Brief Description of the Prior Art

Early electric lights usually comprise bulbs with tungsten filaments, which are gradually replaced with fluorescent lights because energy source is getting more expensive, and fluorescent lights consume less electricity than bulbs with tungsten filaments. Such a fluorescent light includes a fluorescent lamp tube capable of producing light traveling in all directions, and an external device, which is used to hold the fluorescent lamp tube in position and electrically connect the fluorescent lamp tube to a power supply, and which can reflect light produced by the fluorescent lamp tube to the area to be lighted.

However, such a fluorescent light isn't bright enough because the external device doesn't have good light reflectivity, and there is a significant distance between the fluorescent lamp tube and the external device, which would cause reduction to the brightness.

SUMMARY OF THE INVENTION

It is a main object of the present invention to provide an improvement on a light structure to overcome the above problems.

A light structure according to an embodiment of the present invention includes a light-producing inner tube, and an outer tube positioned around the light-producing inner tube. The light-producing inner tube has electrical terminals at two ends thereof, which sticks out of the outer tube. The outer tube has a light reflecting film on an outer side of a first portion thereof, and an inner side of the first portion is processed so as to have a rough and lumpy surface, which can cause light produce by the light-producing inner tube to travel in all directions. The outer tube has fluorescent layers on both inner and outer sides of a second portion thereof, which can make the second portion of the outer tube more pervious to light.

BRIEF DESCRIPTION OF THE DRAWINGS

The present invention will be better understood by referring to the accompanying drawings, wherein.

DETAILED DESCRIPTION OF THE PREFERRED EMBODIMENTS

Figure 1:
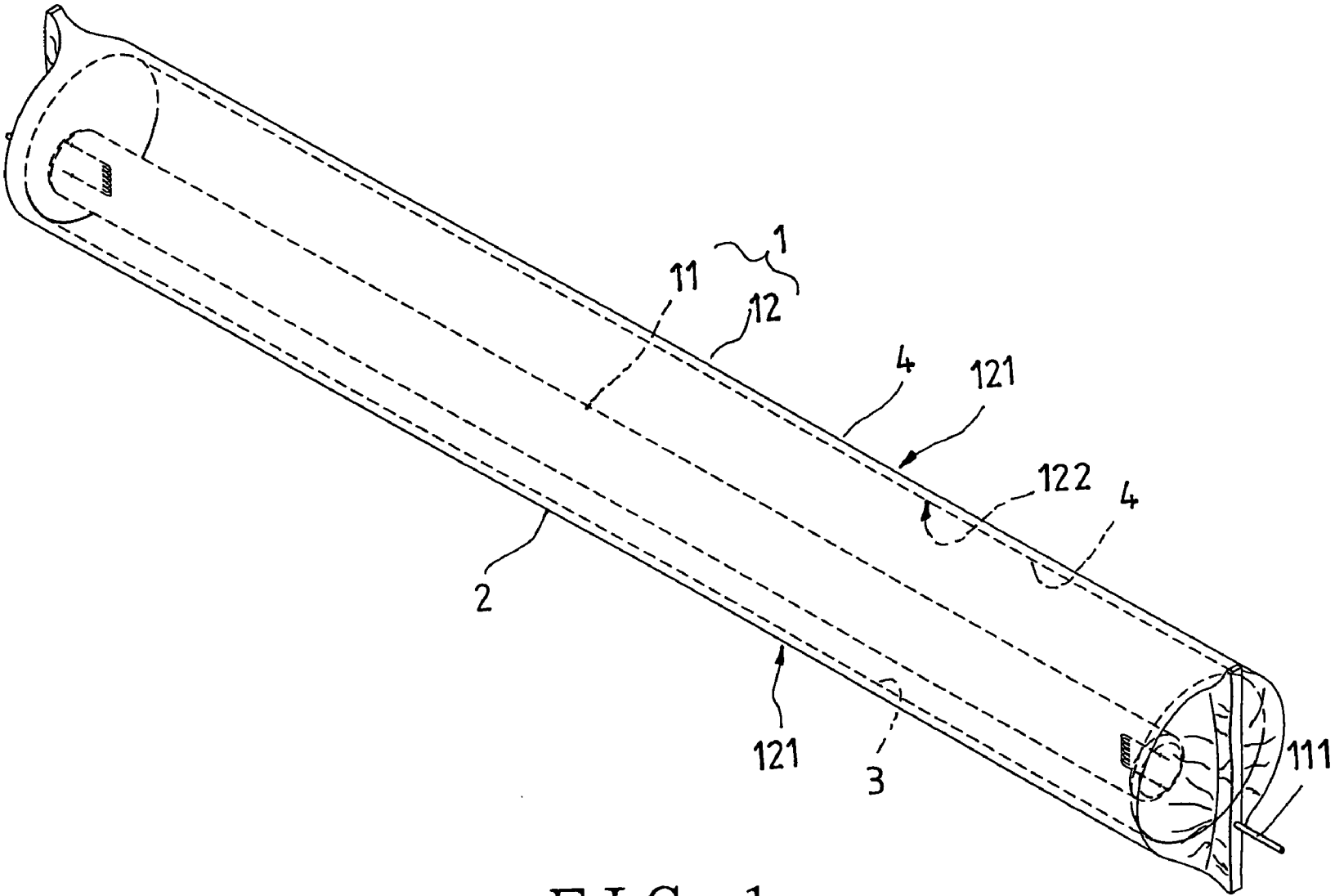
FIG. 1 is a perspective view of the present invention.
Figure 2:
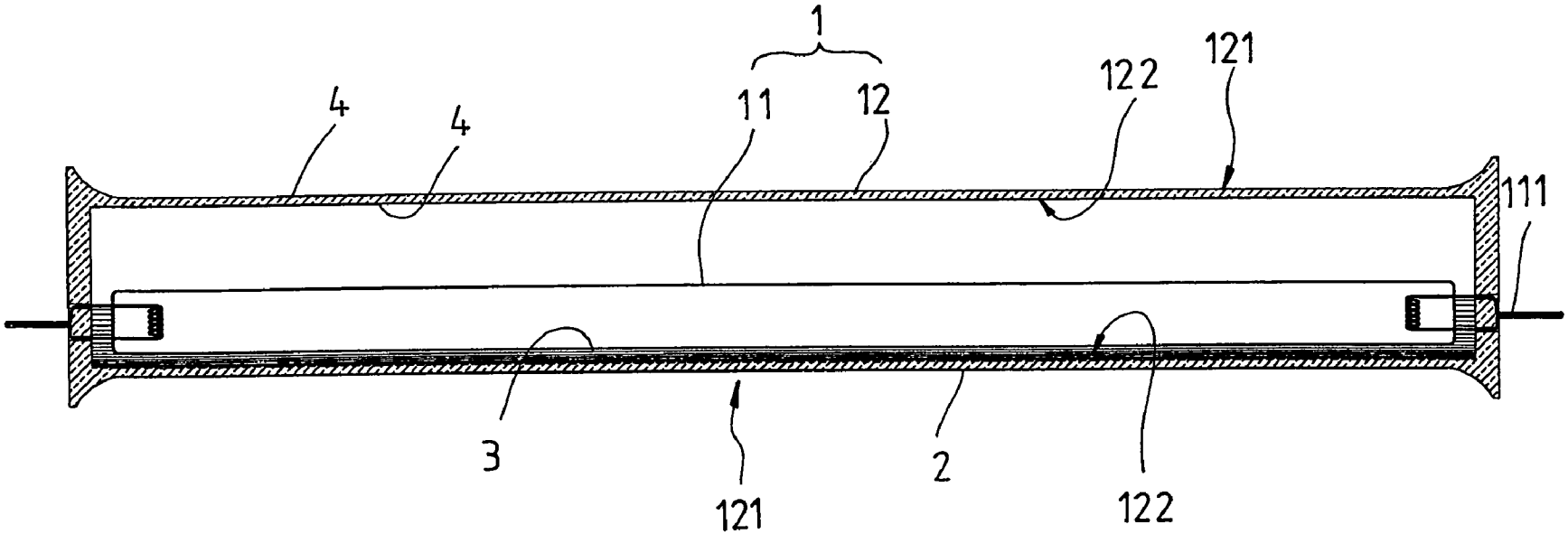
FIG. 2 is a front sectional view of the present invention.
Figure 3:
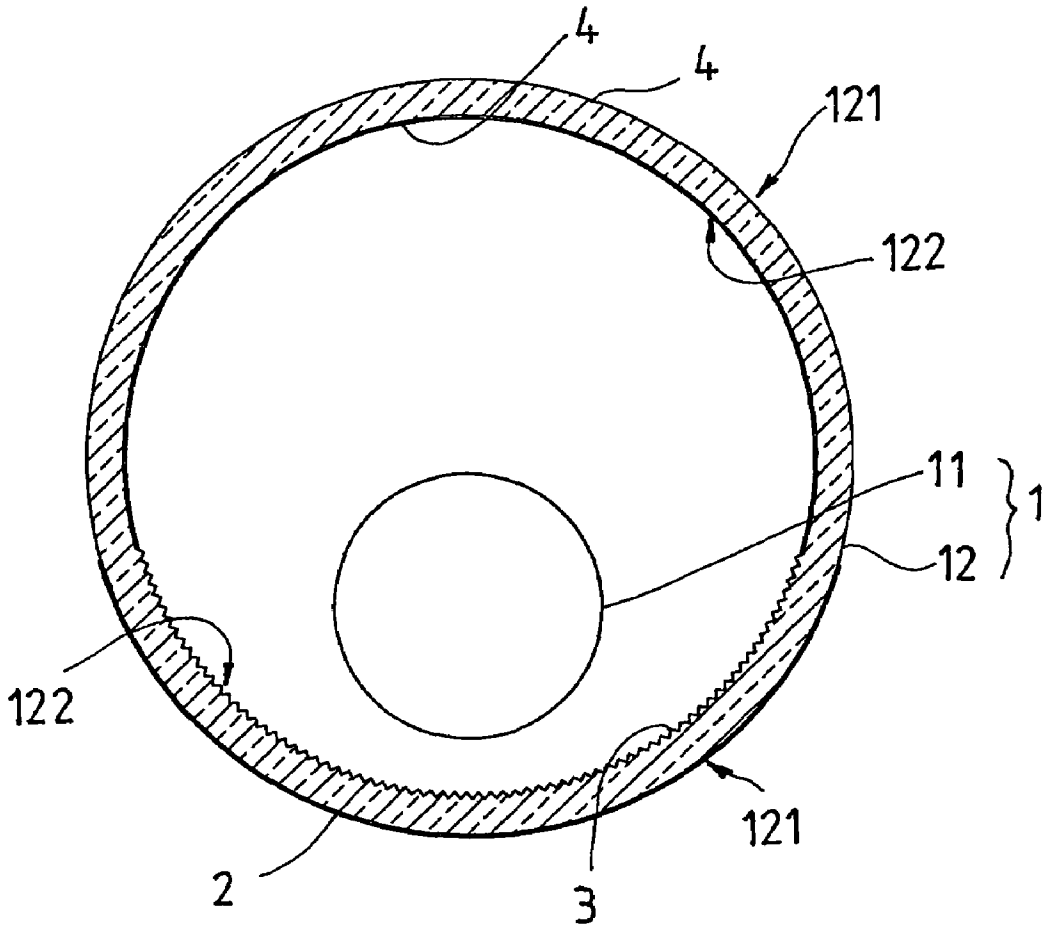
FIG. 3 is a lateral sectional view of the present invention.
Figure 5:
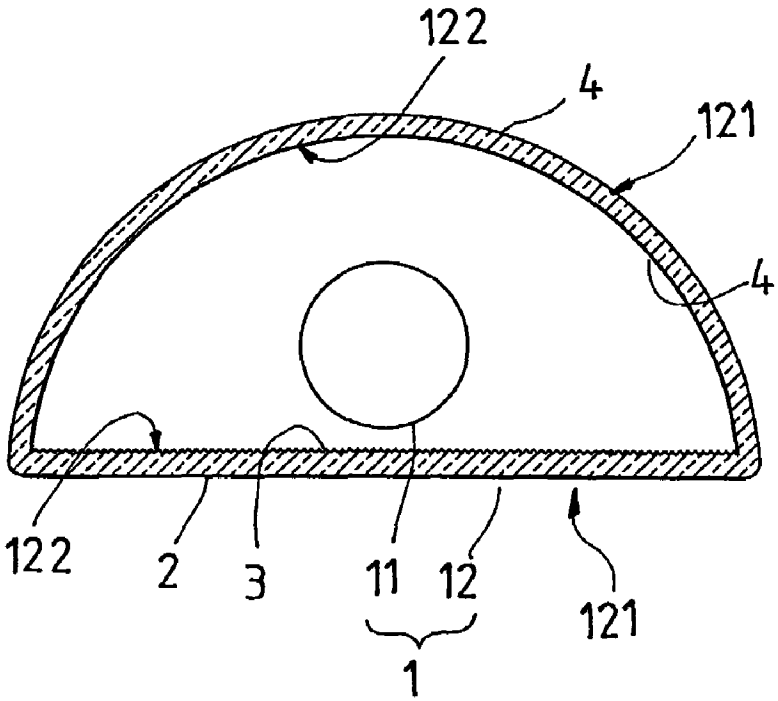
FIG. 5 is a lateral section of the present invention with a semicircular outer tube.
Figure 4:
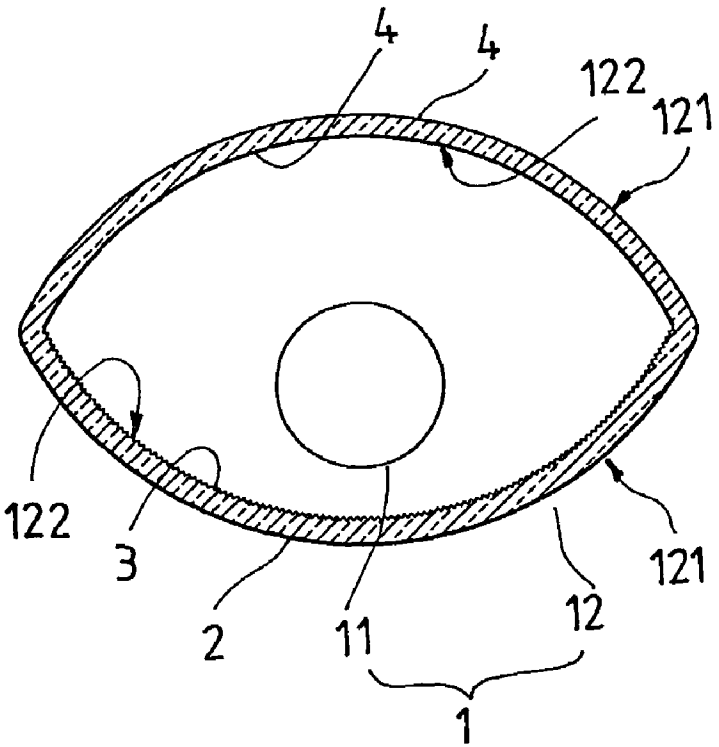
FIG. 4 is a lateral section of the present invention with an olive-shaped outer tube.

Referring to FIG. 1 to FIG. 3, a preferred embodiment of a light 1 of the present invention includes a light-producing inner tube 11, and an outer tube 12.

The light-producing inner tube 11 has electrical terminals 111 at two ends to be electrically connected to an external device in order for allowing the inner tube 11 to be powered and produce light.

The outer tube 12 is positioned around the light-producing inner tube 11 with the electrical terminals 111 of the light-producing inner tube 11 sticking out of two ends thereof. The outer tube 12 is made of a transparent material such as glass and quartz, and can be formed with a circular, olive-shaped, semicircular lateral or other-shaped section.

Furthermore, the outer tube 12 has a first portion having an outer side 121 and an inner side 122; the outer side 121 of the first portion of the outer tube 12 has a light reflecting film 2 thereon for reflecting light produced by the light-producing inner tube 11 inwardly; the inner side 122 of the first portion of the outer tube 12 is processed in such a way as to have a rough and lumpy surface 3, which can make light produced by the light-producing inner tube 11 travel in all directions. The outer tube 12 has a second portion, which faces the first portion of the outer tube 12, and which has an outer side 121, and an inner side 122; each of both the outer and the inner sides 121 and 122 of the second portion of the outer tube 12 has a fluorescent layer 4 thereon for making the second portion of the outer tube 12 more pervious to light; thus, the light 1 is brighter; the fluorescent layers 4 can be stuck on the outer tube 12 or formed by means of a coating process.

Figure 6:
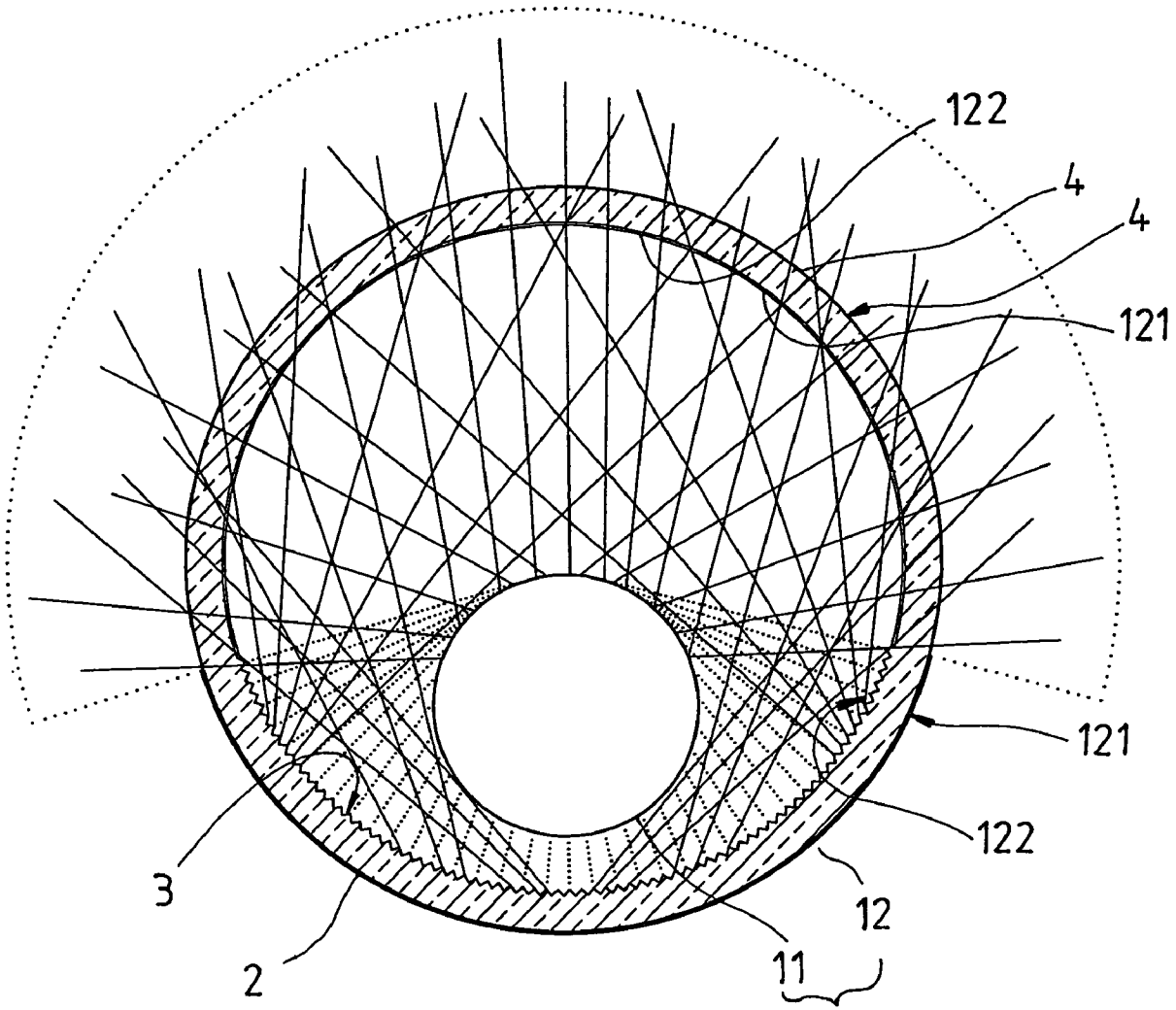
FIG. 6 is a lateral sectional view of the present invention in use.

Referring to FIGS. 1 and 6, the light 1 is connected to an external device at the electrical terminals 111 with the second portion of the outer tube 12 facing the area to be lighted up, which has the fluorescent layers 4 on both the inner and the outer sides 122 and 121. Therefore, light produced by the light-producing inner tube 11 will be reflected by the light reflecting film 2 on the outer side 121 of the first portion of the outer tube 12, and made to travel in all directions by means of the rough and lumpy surface 3 on the inner side of the first portion of the outer tube 12, and travel out of the light 1 through the second portion of the outer tube 12, which is highly pervious to light owing to the existence of the fluorescent layers 4 on both the inner and the outer sides 122 and 121 of the second portion of the outer tube 12. Therefore, the light 1 is relatively bright.

From the above description, it can be seen that the light of the present invention has an advantage: because the first portion of the outer tube has the light reflecting film and the rough and lumpy surface, and the second portion of the outer tube has the fluorescent layers, the light has more brightness, thus producing better illuminating effect.

What is claimed is:

1. An improvement on a light structure, comprising a light-producing inner tube, the light-producing inner tube having electrical terminals at two ends thereof; and an outer tube, the outer tube being positioned round the light-producing inner tube with the electrical terminals of the light-producing inner tube sticking out;

the outer tube having first and second portions; the outer tube having a light reflecting film on an outer side of the first portion thereof; an inner side of the first portion of the outer tube having a rough and lumpy surface;

the outer tube having fluorescent layers on both inner and outer sides of the second portion thereof.

2. The improvement on a light structure as recited in claim 1, wherein the outer tube is made of a transparent material.

3. The improvement on a light structure as recited in claim 1, wherein the outer tube has a circular section.

4. The improvement on a light structure as recited in claim 1, wherein the outer tube has an oval section.

5. The improvement on a light structure as recited in claim 1, wherein the outer tube has a semicircular section.

6. The improvement on a light structure as recited in claim 1, wherein the fluorescent layers are formed on the outer tube by means of a coating process.

7. The improvement on a light structure as recited in claim 1, wherein the fluorescent layers are stuck on the outer tube.

* * * * *